US009739429B2

(12) United States Patent
Bah

(10) Patent No.: US 9,739,429 B2
(45) Date of Patent: Aug. 22, 2017

(54) LIGHT APPARATUS

(71) Applicant: Thierno Souleymane Bah, Fort Collins, CO (US)

(72) Inventor: Thierno Souleymane Bah, Fort Collins, CO (US)

( * ) Notice: Subject to any disclaimer, the term of this patent is extended or adjusted under 35 U.S.C. 154(b) by 574 days.

(21) Appl. No.: 14/324,139

(22) Filed: Jul. 4, 2014

(65) Prior Publication Data

US 2015/0009657 A1 Jan. 8, 2015

(51) Int. Cl.

*F21L 4/00* (2006.01)
*F21L 4/08* (2006.01)
*F21V 17/16* (2006.01)

(52) U.S. Cl.

CPC ..... *F21L 4/08* (2013.01); *F21V 17/164* (2013.01)

(58) Field of Classification Search

CPC .. H05B 33/0845; H05B 37/00; Y02B 20/341; H02J 11/00; H02J 9/065
USPC ..... 362/183
See application file for complete search history.

(56) References Cited

U.S. PATENT DOCUMENTS

2009/0213588 A1* 8/2009 Manes ..... F21S 8/086 362/235
2012/0200235 A1* 8/2012 Shuy ..... H05B 33/0845 315/297
2014/0368118 A1* 12/2014 Bhardwaj ..... H05B 33/0815 315/175

* cited by examiner

*Primary Examiner* — William Carter
(74) *Attorney, Agent, or Firm* — Roger A. Jackson

(57) ABSTRACT

A light apparatus is disclosed that is equipped to be portable and self-sustaining with a feature to recharge most electronic devices such as a cellular phone. The light apparatus includes two parts; a mechanical part and an electronic one. The mechanical part has a diffuser dome diffusing an LED light, a heat sink plate absorbing and transferring the heat away from the LED light, a first and a second solar panel housing supporting a first and second solar panels respectively that are disposed at an angle allowing the recharge of a battery, a surrounding sidewall and base housing the battery and the second part electronic circuitry for controlling electrical power to maximize LED and battery life. The light apparatus is also equipped with a handle arm used for transport or hanging of the light apparatus and a USB port for recharging of electronic devices.

8 Claims, 14 Drawing Sheets

LIGHT APPARATUS

RELATED PATENT APPLICATION

This application is a continuation in part application that claims a priority benefit from African Intellectual Property Organization (OAPI) patent application serial number GN/2013/0001 filed on Jul. 5, 2013 by Thierno Souleymane Bah of Conakry, Republic of Guinee.

TECHNICAL FIELD

The present invention relates generally to a light apparatus for providing ambient lighting at night. More specifically, the present invention relates to the field of portable lighting apparatus that has a rechargeable power source that obtains power from a solar panel and has an auxiliary port for electrically powering accessories such as a cell phone, GPS, and the like.

BACKGROUND OF INVENTION

The need for portable self-sustaining power is a given, especially in the undeveloped world, wherein in the case of lighting typically kerosene or dung are burned for lighting, either of which are dangerous from the open flame aspect and also pollute the air that is usually in a confined interior space. One aspect of self-sustaining power is in recharging a battery for instance from a solar panel power source, wherein the battery while discharging can power a light and also provide low level power to electronic devices such as phones, GPS, speakers, microphones, and the like. So with the solar power rechargeable light with accessory power port, you have a much safer and cleaner power/light source without the fire risk and without the air pollution.

The manufacturing of solar light apparatus has existed in the prior art, however, having a low intensity of light that only typically lasts for a short time, further the solar light apparatus in the prior art are also typically not equipped with auxiliary ports to transfer electrical energy to another electronic device, such as a cell phone for recharging.

In use the solar light apparatus is to overcome the difficulties of students who are finding it difficult to obtain adequate light for reading and homework leading to the use of street lamps in urban zones and to have to use a charging station to charge their cellular phones.

The intended target for the present invention of the solar light apparatus is the urban and rural zone users, helping them illuminate their homes and to recharge their electronic devices such as the cellular phones.

SUMMARY OF INVENTION

This invention is in regard of a solar light apparatus equipped with a feature to recharge most electronic devices such as the cellular phone.

The solar light apparatus has two essential parts: the mechanical part and the electronic one.

The mechanical part has a diffuser dome diffusing the light just like an ordinary bulb, a circular heat sink plate absorbing the heat which has light emitting diodes, a first and a second solar panel housing supporting a first and second solar panels respectively that are disposed at an angle allowing the immediate recharge of the panels upon sunrise, a surrounding sidewall housing the battery, and the electronic circuit. The solar light apparatus is equipped with a handle arm used for its transport or hanging it. The surrounding sidewall also has an electric circuit with an outlet and a USB port for recharging of electronic devices.

This solar light apparatus helps to remedy the deficit of nighttime lighting and electronic device charging in Africa despite the abundance of sun light.

The electronic part is essentially segmented in three smaller groups as following.

1. Solar panels, regulators, and battery
2. USB accessories, outlets, and fuses

The lamp in question in this invention transforms the solar energy stored in a battery housed in the cylinder from a regulator.

3. A signed light shows the level of the battery charge—The quantity of energy accumulated in the battery is transferred by the regulator to the diodes producing the light. The same energy contained in the battery is also used to recharge electronic devices These and other objects of the present invention will become more readily appreciated and understood from a consideration of the following detailed description of the exemplary embodiments of the present invention when taken together with the accompanying drawings, in which;

REFERENCE NUMBERS IN DRAWINGS

Figure 5:
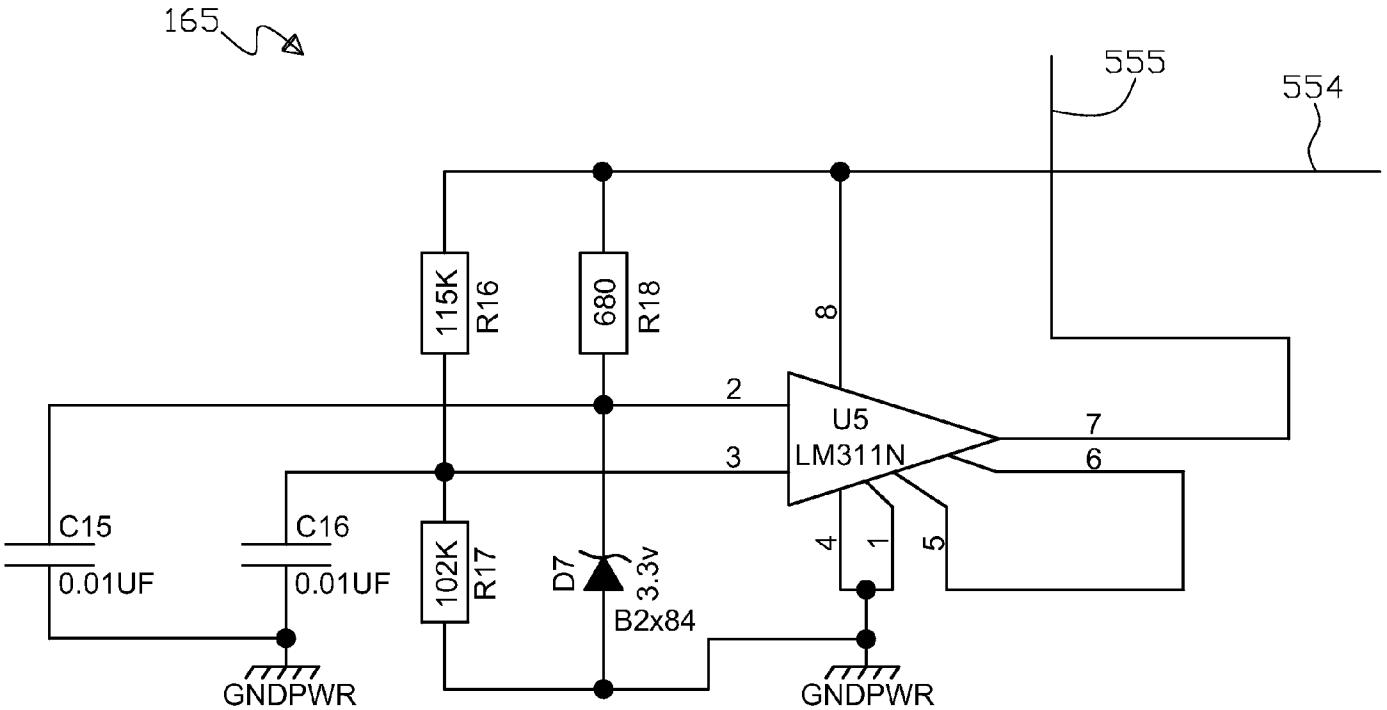
FIG. 5 shows an electrical schematic for a low input voltage comparator that functions to shut off the LED when the voltage goes below 5.73 V to control the potential over discharging of the battery.
Figure 6:
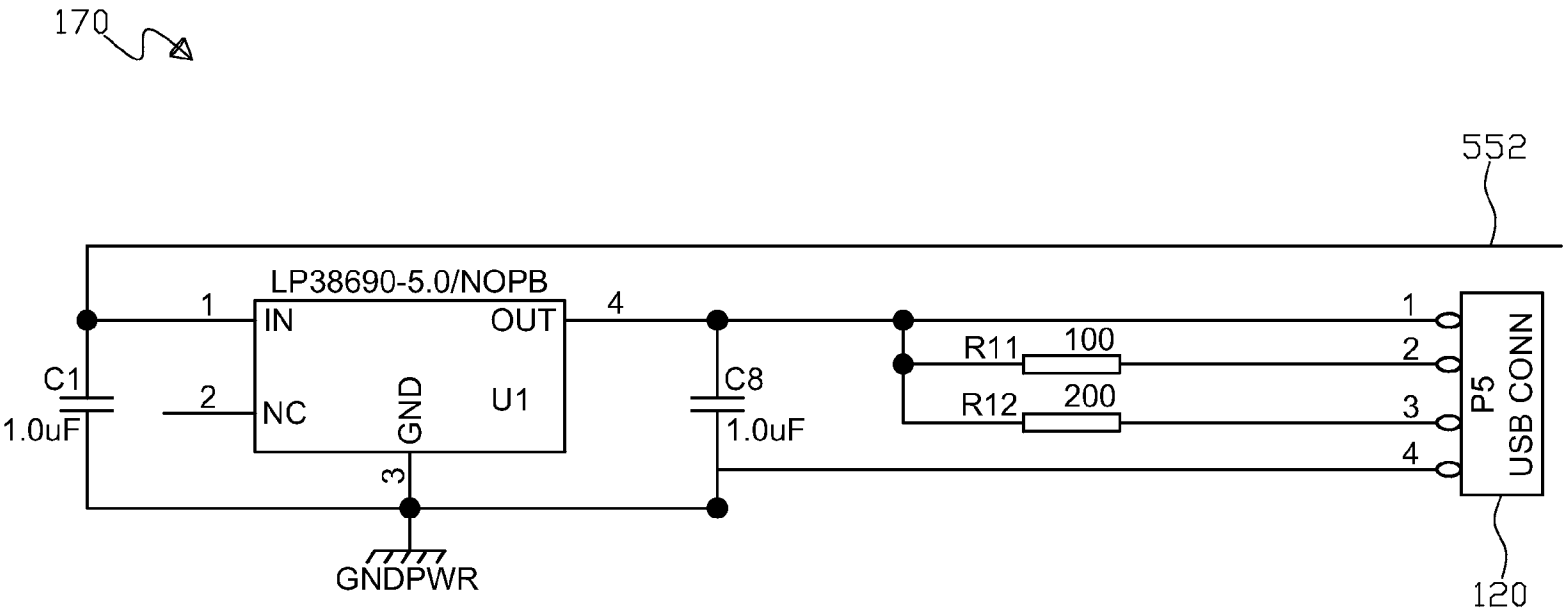
FIG. 6 shows an electrical schematic for a USB port charging circuitry.
Figure 7:
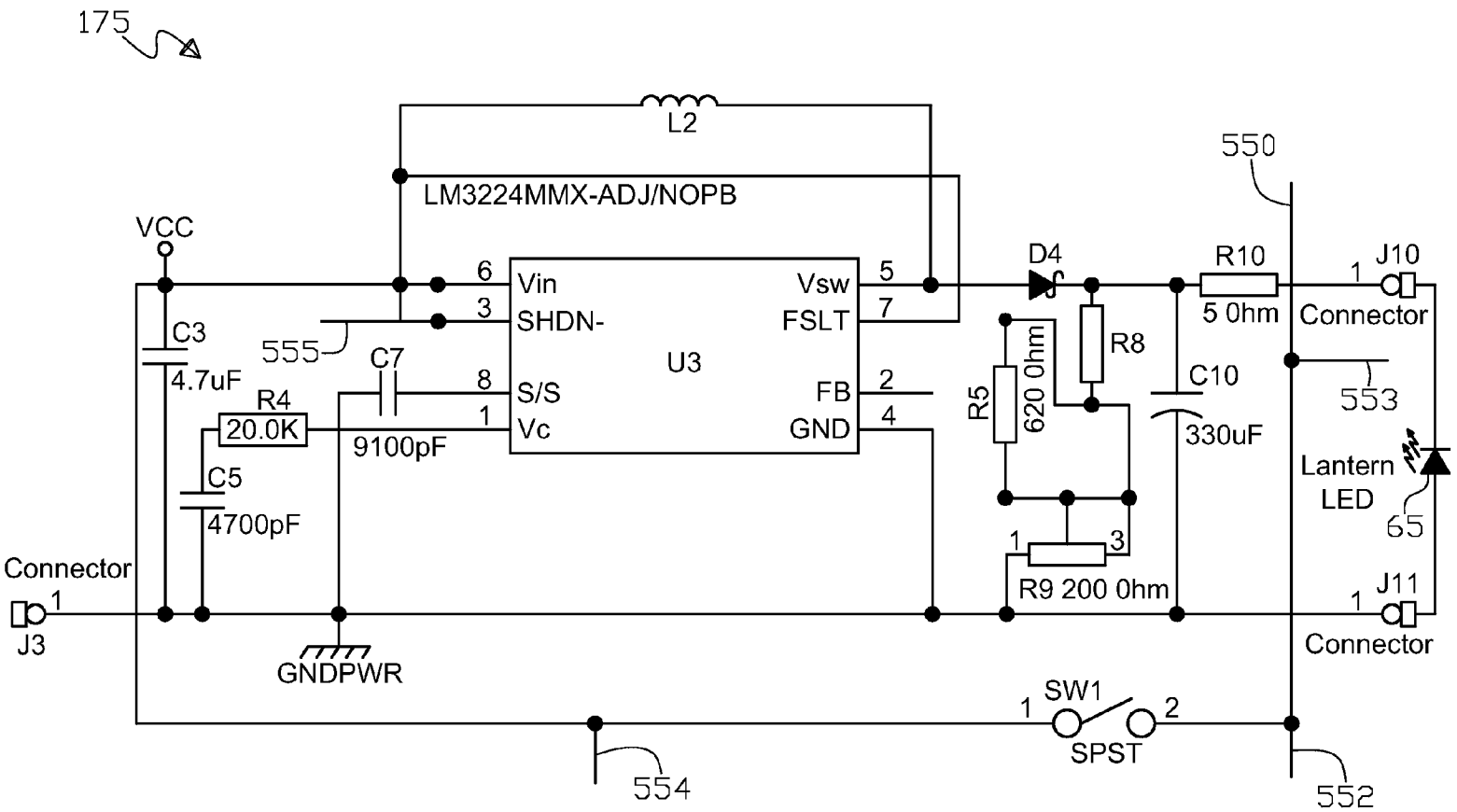
FIG. 7 shows an electrical schematic for a driver controller of the light source LED.

50 Light Apparatus
51 Varying light
55 Diffuser dome for LED 65
60 Heat Sink is preferably a brand GC electronics part number 10-8109
61 Thermo compound
62 Planar area of heat sink 60
65 Light Emitting Diode LED or structure that emits light is preferably brand Cree part number CXA: 1034-000-00000HC250H
66 Largest single surface area of LED 65
70 First solar panel is preferably brand Parallax part number 750-00030 type Mono-Crystalline Silicon
71 First periphery of the first solar panel 70
75 First solar panel housing
76 Affixed portion of first solar panel housing to the LED 65
80 Second solar panel is preferably brand Parallax part number 750-00030 type Mono-Crystalline Silicon
81 Second periphery of the second solar panel 80
85 Second solar panel housing
86 Affixed portion of the second solar panel housing to the margin 106
90 Hinge disposed between the first solar panel housing and second solar panel housing that pivots
95 Closed state of the light apparatus
100 Open state of the light apparatus
101 First plane
102 Acute angle
103 Perpendicular position of varying light to the first plane 101
105 Surrounding sidewall
106 Margin of surrounding sidewall 105
107 First interior
110 Base
111 Housing
115 Handle
120 USB Port
125 Electrical outlet
130 USB to AC adapter cord
135 USB male connector
140 AC female connector
145 AC to phone charging port adapter cord
150 AC male connector
155 Phone charging port connector
160 Cell phone or auxiliary device
165 Low input voltage comparator circuitry or storage structure protection circuitry
170 USB charging circuitry or auxiliary circuitry
175 Driver controller circuitry of the light source LED or control circuitry
180 Boost regulator having a first cycle of operation and a second cycle of operation
185 Solar charging circuitry or control circuitry
190 Charging LED status circuitry
195 Battery or storage structure is preferably a brand TYSONIC part number TY-6-4.5 having specifications of 6V and 4.5 Amp-Hours rating
550 Electrical connection from FIG. 7 to FIG. 9
552 Electrical connection from FIG. 6 to FIG. 7
553 Electrical connection from FIG. 7 to FIG. 10
554 Electrical connection from FIG. 5 to FIG. 7
555 Electrical connection from FIG. 5 to FIG. 7

REFERENCE PREFERRED ELECTRICAL COMPONENTS IN DRAWINGS

| Reference | Design Value | Footprint | Manufacturer | Manufacturer P/N |
|---|---|---|---|---|
| C1 | 1.0 uF | C0603 | TDK | C1608X5R1A105K |
| C2 | 4.7 uF | 1206 | TDK | C3216X7R1C475K |
| C3 | 4.7 uF | 1206 | TDK | C3216X7R1C475K |
| C4 | 4700 pF | C0805 | Yageo America | CC0805KRX7R9BB472 |
| C5 | 4700 pF | C0805 | Yageo America | CC0805KRX7R9BB472 |
| C6 | 9100 pF | C0805 | MuRata | GRM2195C1H912JA01D |
| C7 | 9100 pF | C0805 | MuRata | GRM2195C1H912JA01D |
| C8 | 1.0 uF | C0603 | TDK | C1608X5R1A105K |
| C9 | 330 uF | SMDHD/VF | Panasonic | EEE-FK1A331P |
| C10 | 330 uF | SMDHD/VF | Panasonic | EEE-FK1A331P |
| C11 | 0.01 UF | C0805 | Yageo America | CC0805KRX7R9BB103 |
| C13 | 0.01 UF | C0805 | Yageo America | CC0805KRX7R9BB103 |
| C14 | 0.01 UF | C0805 | Yageo America | CC0805KRX7R9BB103 |
| C15 | 0.01 UF | C0805 | Yageo America | CC0805KRX7R9BB103 |
| C16 | 0.01 UF | C0805 | Yageo America | CC0805KRX7R9BB103 |
| D1 | 6.8 V | DO-214AA | Micro Commercial CO | SMBJ5342B 6.8V |
| D2 | 3.0 V 1% | SOT-23-3 | NXP Semiconductors | BZX84-A3V0215 |
| D3 | DIODESCH | DO-214AC | Diodes Inc. | B220A-13-F |
| D4 | DIODESCH | DO-214AC | Diodes Inc. | B220A-13-F |
| D5 | LED | T-1¾ | Avago | HLMP-EG35-TW0DD |
| D6 | LED | T-1¾ | Avago | HLMP-3507-D0002 |
| D7 | 3.0 V 1% | SOT-23-3 | NXP Semiconductors | BZX84-A3V0215 |
| F1 | 1.5 A | 1206 | Littlefuse Inc. | 043701.5WR |
| IC1 | 4N25 | 6-SMD | Lite-on Inc. | 4N25S-TA1 |
| J1 | CONNECTOR | Small_pin | Part of PCB | Part of PCB |
| J2 | CONNECTOR | Small_pin | Part of PCB | Part of PCB |
| J3 | CONNECTOR | Small_pin | Part of PCB | Part of PCB |
| J8 | CONNECTOR | Small_pin | Part of PCB | Part of PCB |

-continued

| Reference | Design Value | Footprint | Manufacturer | Manufacturer P/N |
|---|---|---|---|---|
| J9 | CONNECTOR | Small_pin | Part of PCB | Part of PCB |
| J10 | CONNECTOR | Small_pin | Part of PCB | Part of PCB |
| J11 | CONNECTOR | Small_pin | Part of PCB | Part of PCB |
| L1 | 15.0 uH | BOURNS_SMD | Bourns | SRN6045-150M |
| L2 | 15.0 uH | BOURNS_SMD | Bourns | SRN6045-150M |
| P1 | CONN_1 | Test point | Test point | Test point |
| P2 | CONN_1 | Test point | Test point | Test point |
| P3 | CONN_1 | Test point | Test point | Test point |
| P4 | CONN_1 | Test point | Test point | Test point |
| P5 | USB CONN | TBD | OST | USB-A1VSB6 |
| R1 | 115K | R0603 | Panasonic | ERJ-3EKF1153V |
| R2 | 102K | R0603 | Panasonic | ERJ-3EKF1023V |
| R3 | 20.0K | R0805 | Vishay-Dale | CRCW080520K0FKEA |
| R4 | 20.0K | R0805 | Vishay-Dale | CRCW080520K0FKEA |
| R5 | 620 Ohm | R0805 | Vishay-Dale | CRCW0805620RFKEA |
| R6 | 4.87K | R0805 | Vishay-Dale | CRCW08054K87FKEA |
| R7 | 1.02K | R0805 | Vishay-Dale | CRCW08054K87FKEA |
| R8 | 4.87K | R0805 | Vishay-Dale | CRCW08054K87FKEA |
| R9 | 200 Ohm | Pot | Sichuan Qixing Electronics | RV9312NS-KA15D (15 mm Kurled) |
| R10 | 5 Ohm | 2010 | Ohmite | RW0S6BB5R00FET |
| R11 | 100 Ohm | R0805 | VISHAY-DALE | CRCW0805100RJNTA |
| R12 | 200 Ohm | R0805 | VISHAY-DALE | CRCW0805200RJNTA |
| R13 | 680 | R0805 | Yageo America | RC0805JR-07680RL |
| R14 | 10K | R0805 | Yageo America | RC0805JR-0710KL |
| R15 | 10K | R0805 | Yageo America | RC0805JR-0710KL |
| R16 | 115K | R0805 | Panasonic | ERJ-3EKF1153V |
| R17 | 102K | R0805 | Panasonic | ERJ-3EKF1023V |
| R18 | 680 | R0805 | Yageo America | RC0805JR-07680RL |
| R21 | 75 ohm | R0805 | VISHAY-DALE | CRCW080575R0JNEA |
| SW1 | SPST | Part of R23 (pot) | Sichuan Qixing Electronics | RV9312NS-KA15D (15 mm Kurled) |
| U1 | LP38690-5.0/NOPB | TO-252-3 | Texas Instruments | LP38690DTX-5.0/NOPB |
| U2 | LM3224MMX-ADJ/NOPB | 8-TSSOP | Texas Instruments | LM3224MM-ADJ/NOPB |
| U3 | LM3224MMX-ADJ/NOPB | 8-TSSOP | Texas Instruments | LM3224MM-ADJ/NOPB |
| U4 | LM393 | 8-SOIC | Texas Instruments | LM393DR |
| U5 | LM311 | 8-SOIC | Texas Instruments | LM311MX/NOPB |

DETAILED DESCRIPTION

Figure 1:
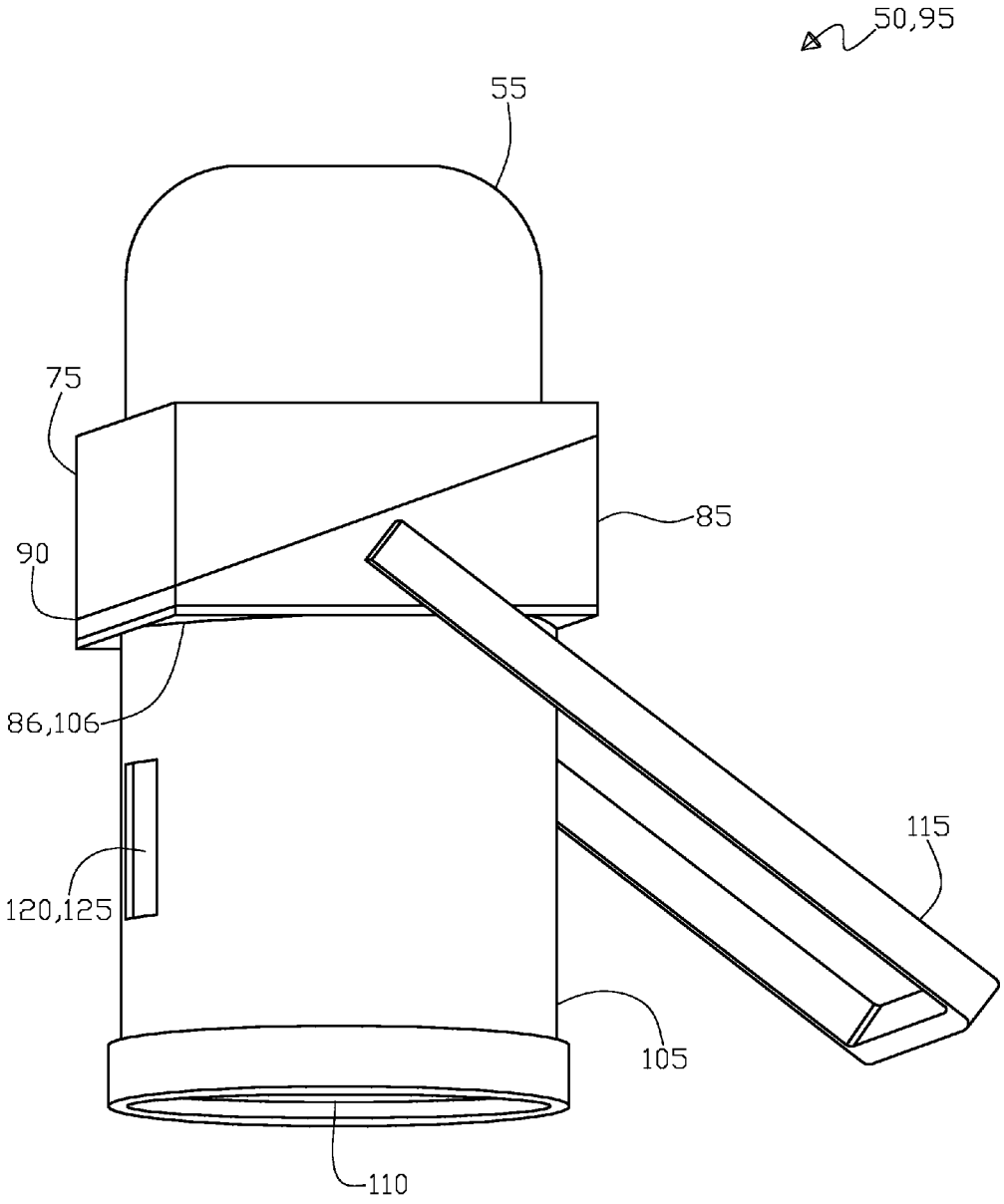
FIG. 1 shows a side elevation view of the light apparatus in the closed state that includes the diffuser dome, the first solar panel housing, the second solar panel housing, the hinge disposed as between the first and second solar panel housings, the handle, the surrounding sidewall, with the USB port disposed in the surrounding sidewall, and the base.
Figure 2:
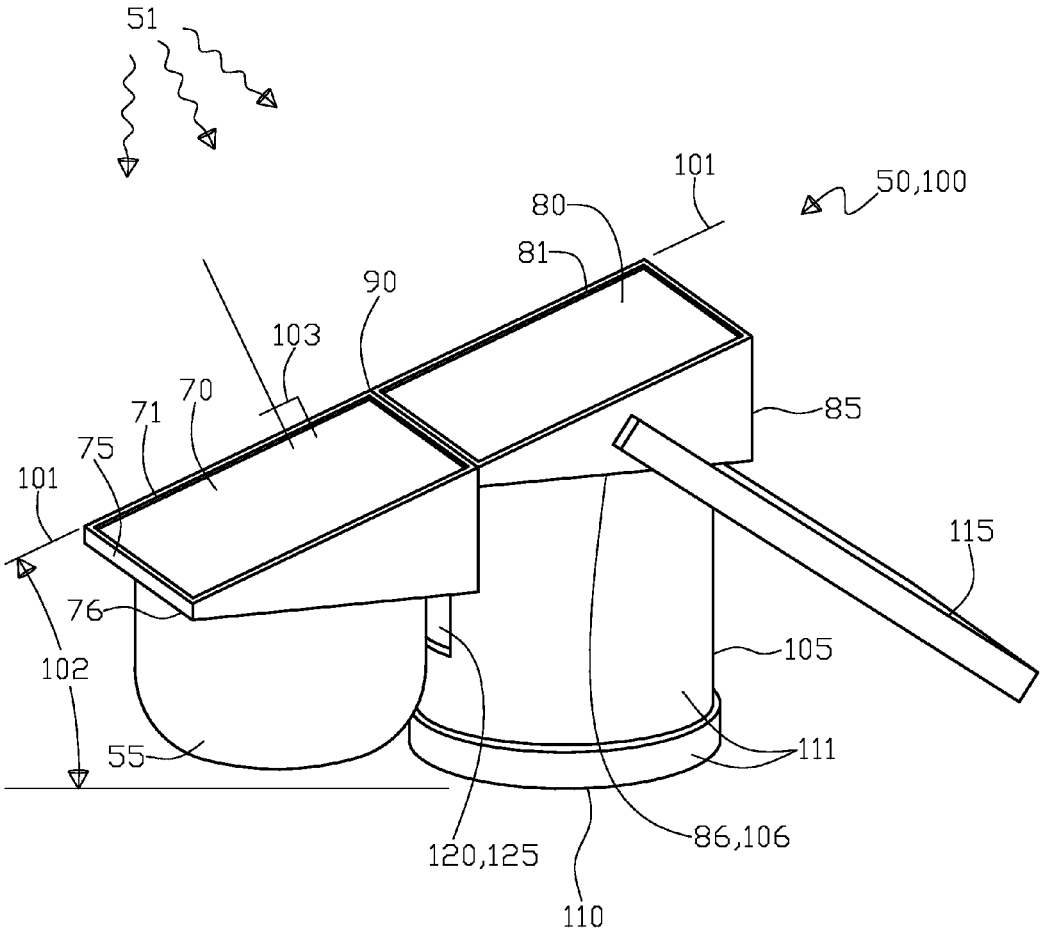
FIG. 2 shows an upper perspective view of the light apparatus in the open state that includes the diffuser dome, the first solar panel housing, the first solar panel, the second solar panel housing, the second solar panel, the hinge disposed as between the first and second solar panel housings, the handle, the surrounding sidewall, with the USB port disposed in the surrounding sidewall, and the base.

With initial reference to FIG. 1 shown is the side elevation view of the light apparatus 50 in the closed state 95 that includes the diffuser dome 55, the first solar panel housing 75, the second solar panel housing 85, the hinge 90 disposed as between the first 75 and second 85 solar panel housings, the handle 115, the surrounding sidewall 105, with the USB port 120 disposed in the surrounding sidewall 105, and the base 110. Next, FIG. 2 shows an upper perspective view of the light apparatus 50 in the open state 100 that includes the diffuser dome 55, the first solar panel housing 75, the first solar panel 70, the second solar panel housing 85, the second solar panel 80, the hinge 90 disposed as between the first 75 and second 85 solar panel housings, the handle 115, the surrounding sidewall 105, with the USB 120 port and electrical outlet 125 disposed in the surrounding sidewall 105, and the base 110.

Figure 3:
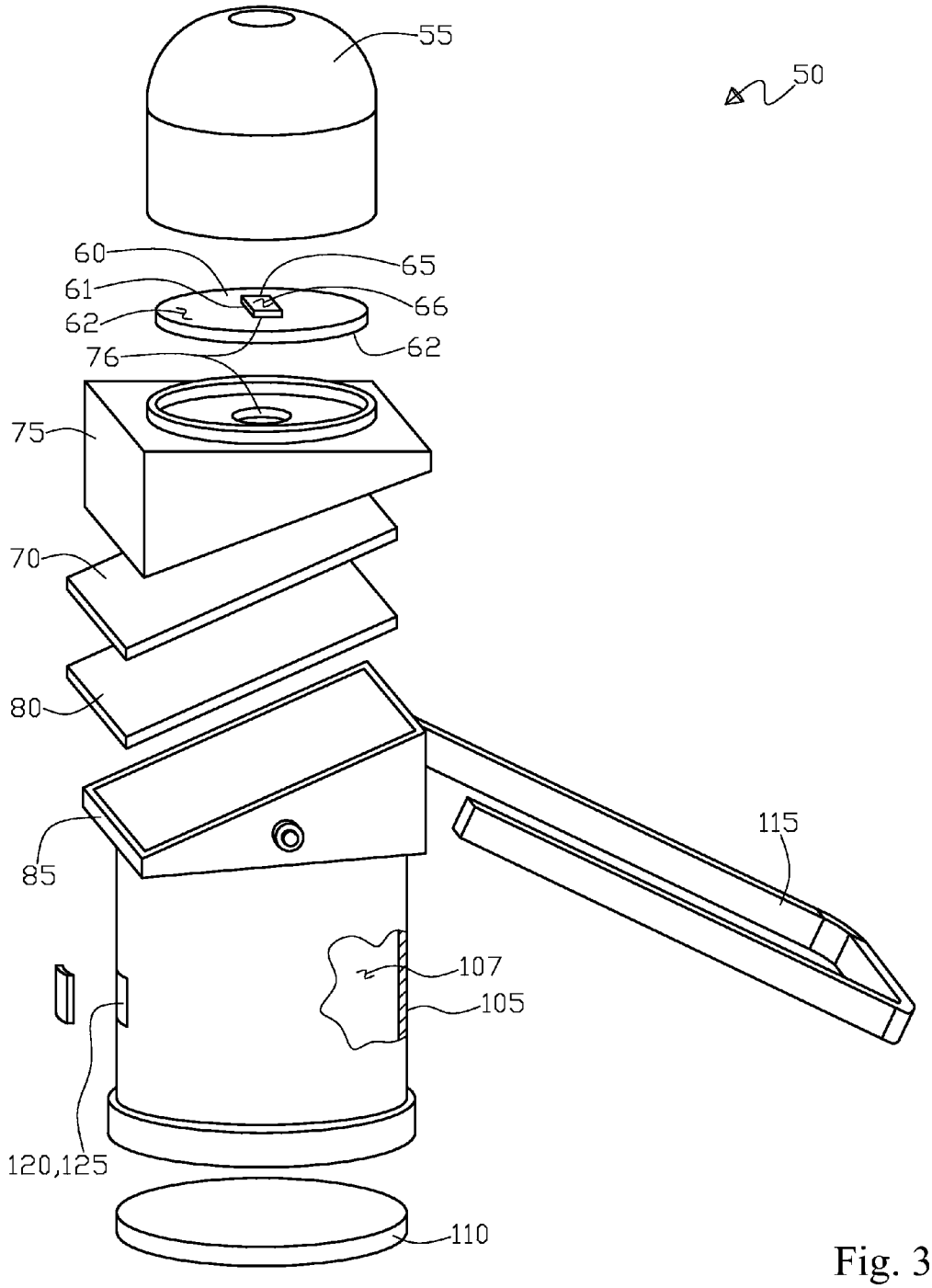
FIG. 3 shows an exploded perspective view of the light apparatus that includes the diffuser dome, the heat sink, the first solar panel housing, the first solar panel, the second solar panel housing, the second solar panel, the handle, the surrounding sidewall, with the USB port disposed in the surrounding sidewall, and the base.
Figure 4:
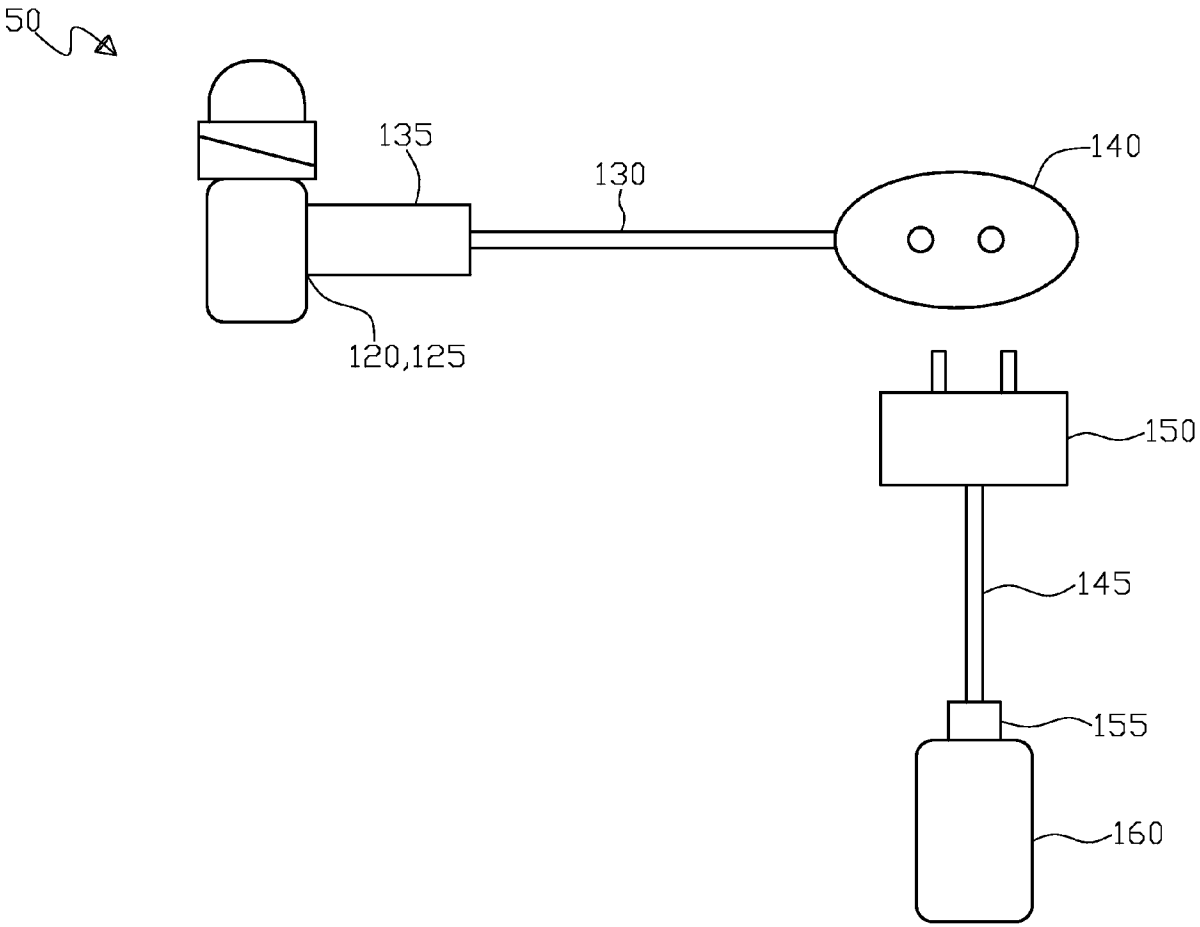
FIG. 4 shows a diagrammatic layout of the light apparatus using a USB to AC female cord adapter that in turn connects to an AC male cord adapter that connects to a cell phone charging connector to enable the cell phone to be charged using a conventional AC plug cord charging adapter that connects to the light apparatus through the USB to AC female cord adapter.

Continuing, FIG. 3 shows an exploded perspective view of the light apparatus 50 that includes the diffuser dome 55, the heat sink 60, the first solar panel housing 75, the first solar panel 70, the second solar panel housing 85, the second solar panel 80, the handle 115, the surrounding sidewall 105, with the USB port 120 disposed in the surrounding sidewall 105, and the base 110. Next, FIG. 4 shows a diagrammatic layout of the light apparatus 50 using a USB to AC female cord 130 adapter that in turn connects to an AC male cord adapter 150 that connects to a cell phone 160 charging connector 155 to enable the cell phone 160 to be charged using a conventional AC plug cord charging adapter 145 that connects to the light apparatus 50 through the USB 120 to male USB 135 to AC female 140 cord adapter that connects to the standard wall AC male plug to phone charging port adapter cord 145.

Figure 8:
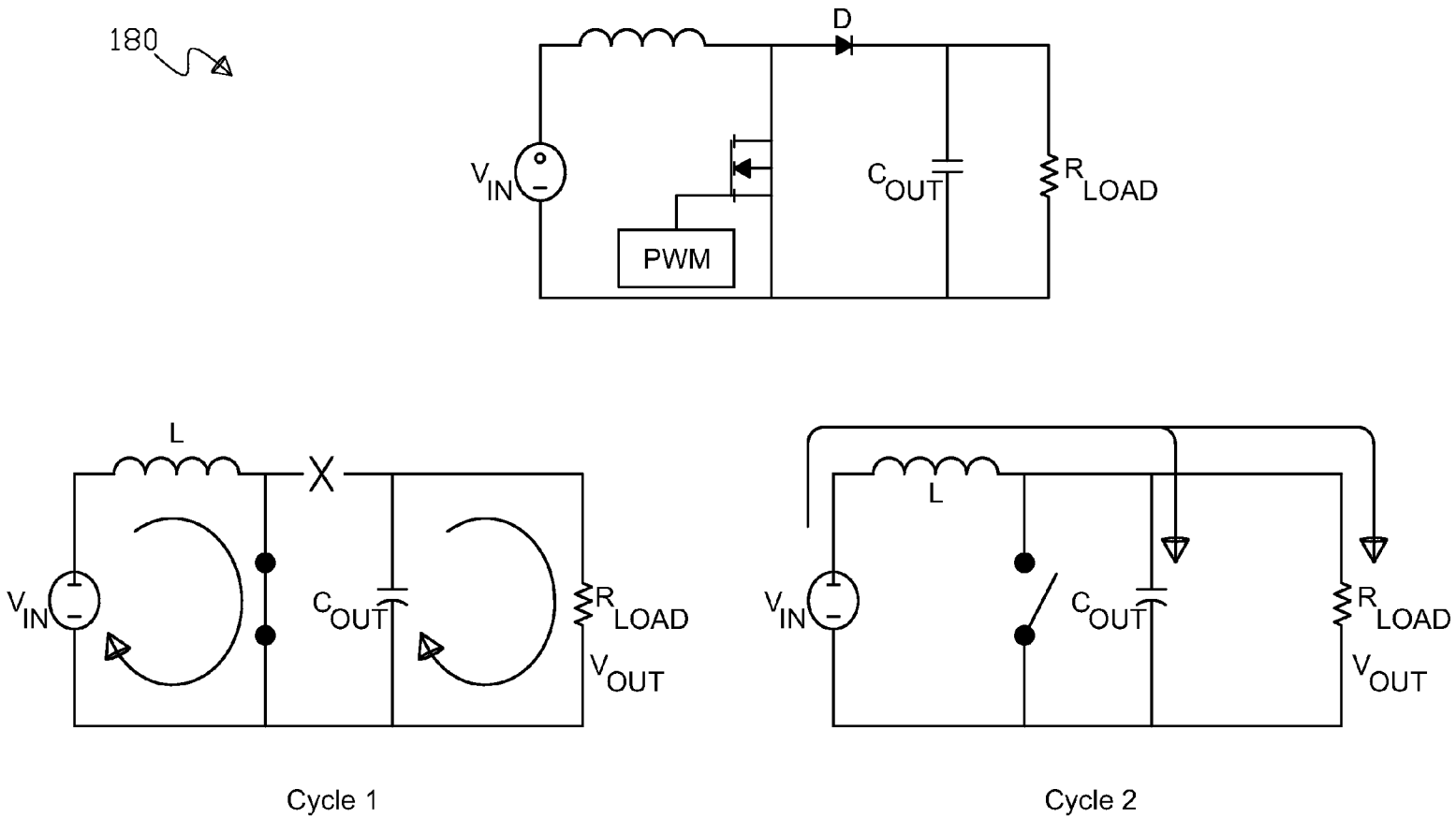
FIG. 8 shows an electrical schematic for a boost regulator having a first cycle of operation and a second cycle of operation.

Continuing, FIG. 5 shows an electrical schematic for a low input voltage comparator circuitry 165 that functions to shut off the LED 65 when the battery 195 voltage goes below 5.73 V to control the potential over discharging of the battery 195. Further, FIG. 6 shows an electrical schematic circuitry 170 for the USB 120 port charging circuitry and FIG. 7 shows an electrical schematic 175 for a driver controller of the light source LED 65. Next, FIG. 8 shows an electrical schematic 180 for a boost regulator having a first cycle of operation and a second cycle of operation and FIG. 9 shows an electrical schematic 185 for a solar charging circuitry.

Figure 10:
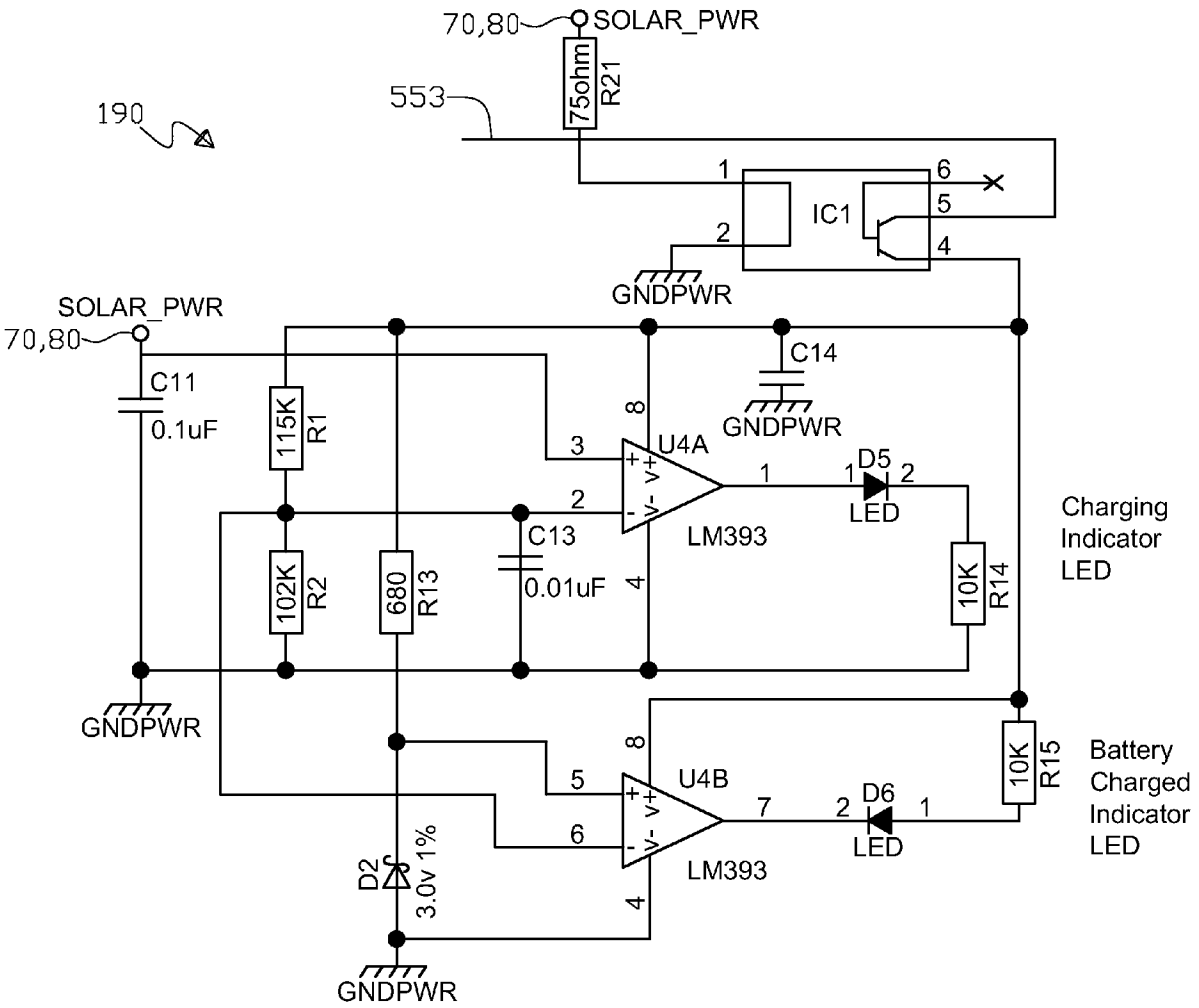
FIG. 10 shows an electrical schematic for a charging status LED.
Figure 11:
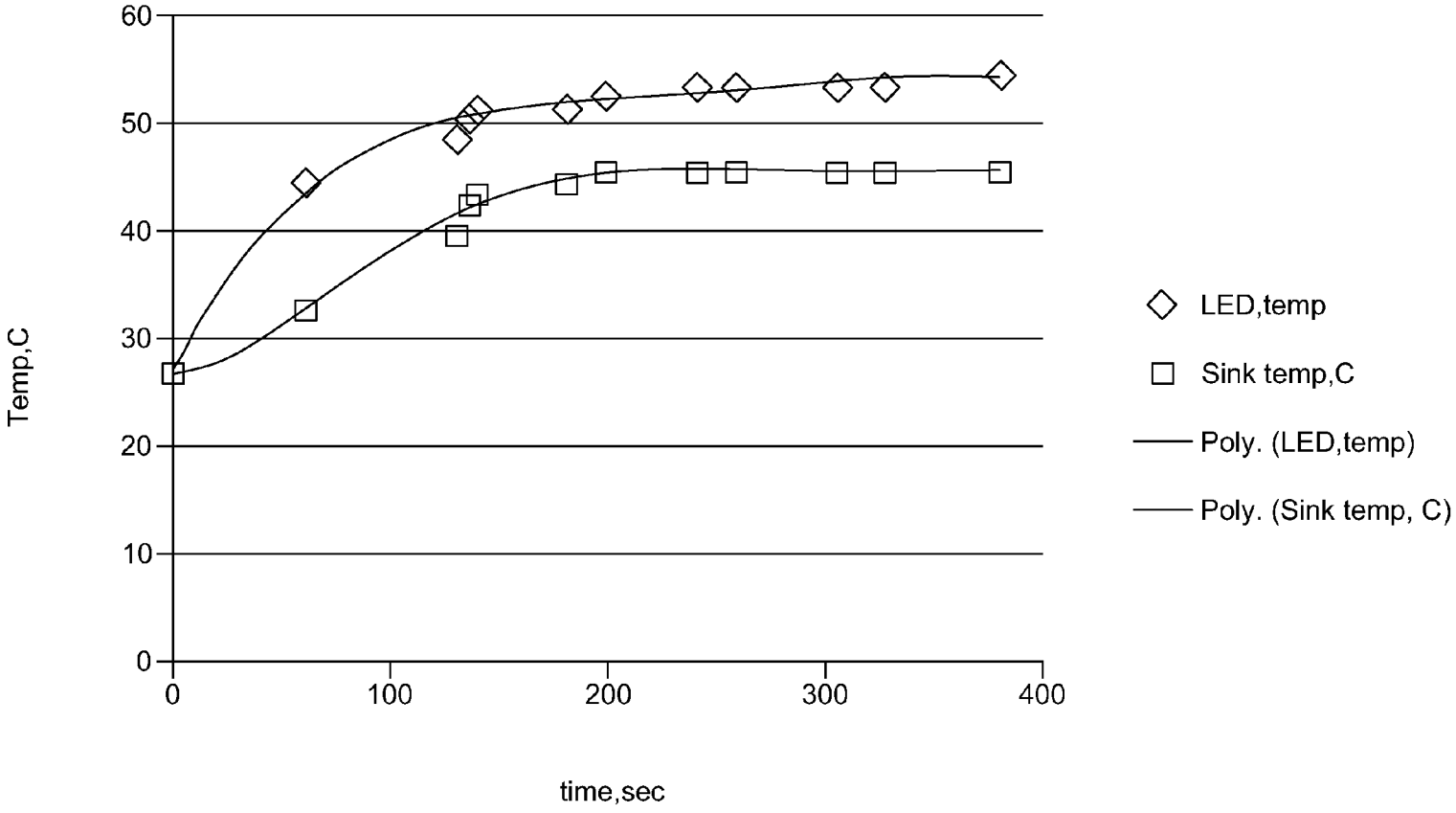
FIG. 11 shows a test data plot using the heat sink that facilitates the LED being operated within its temperature limit.
Figure 12:
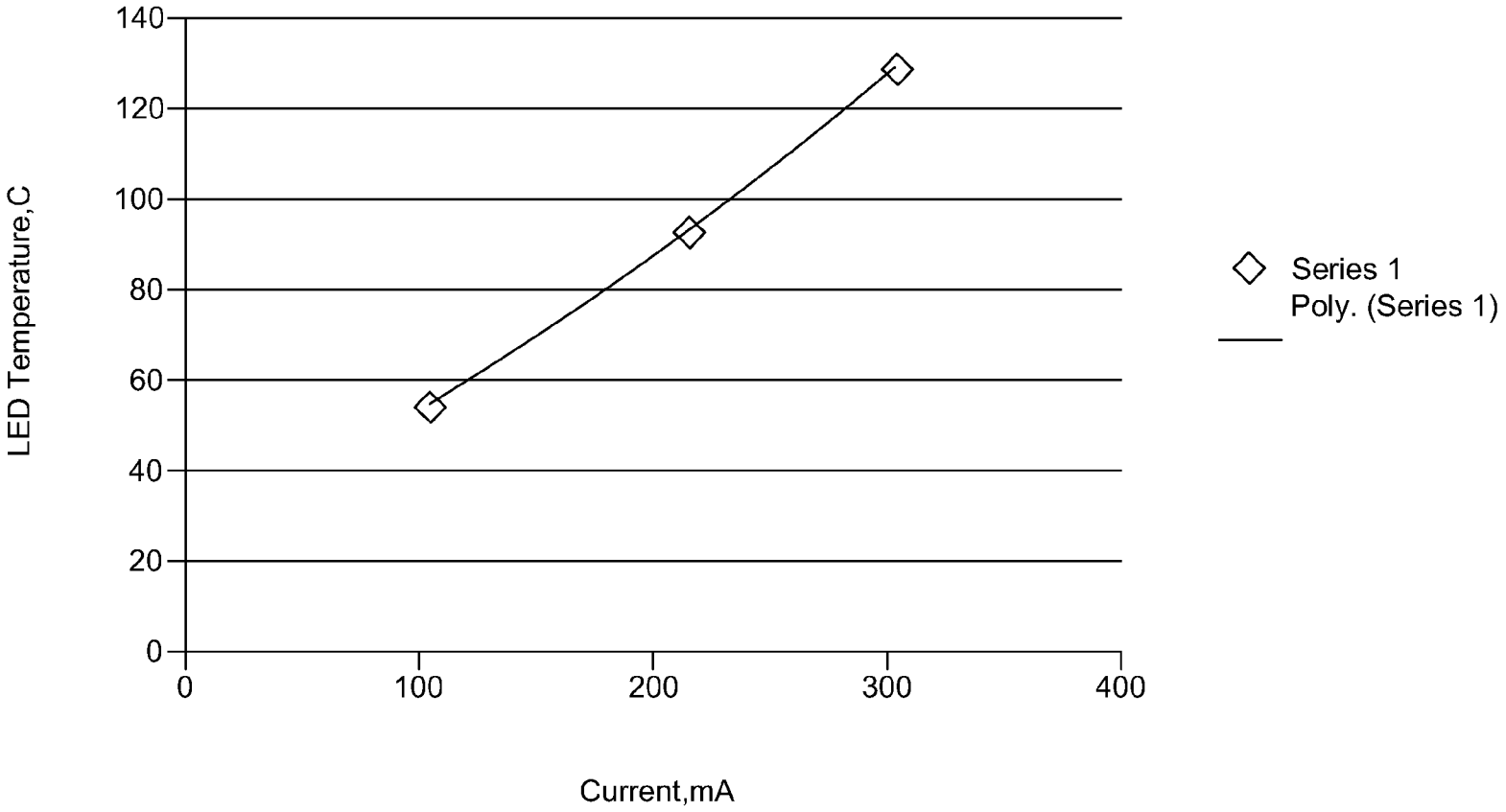
FIG. 12 shows a test data plot of a steady state temperature of a LED case at various forward currents without a heat sink.
Figure 13:
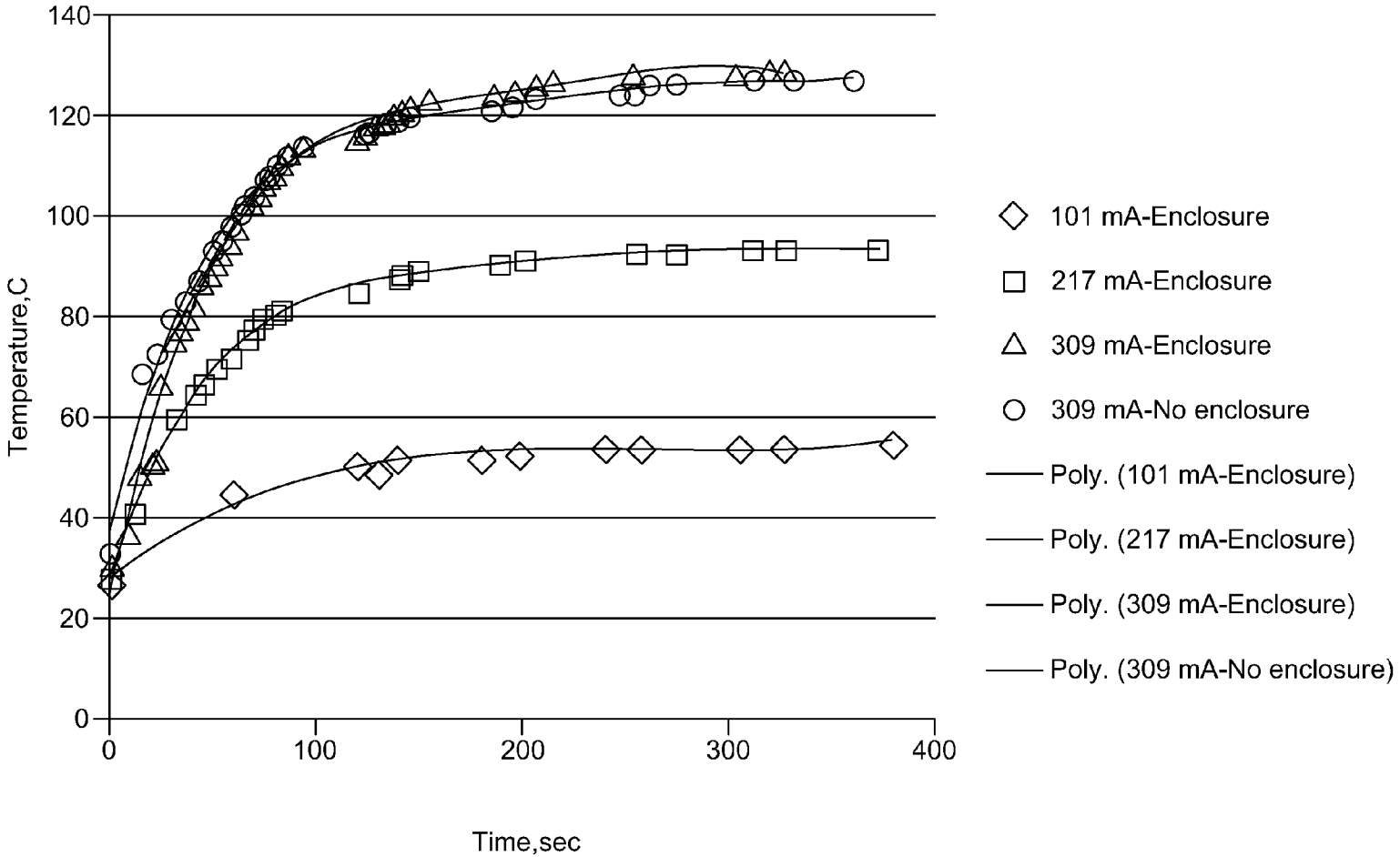
FIG. 13 shows a test data plot showing the transient temperature of the LED case at various forward currents without a heat sink.
Figure 14:
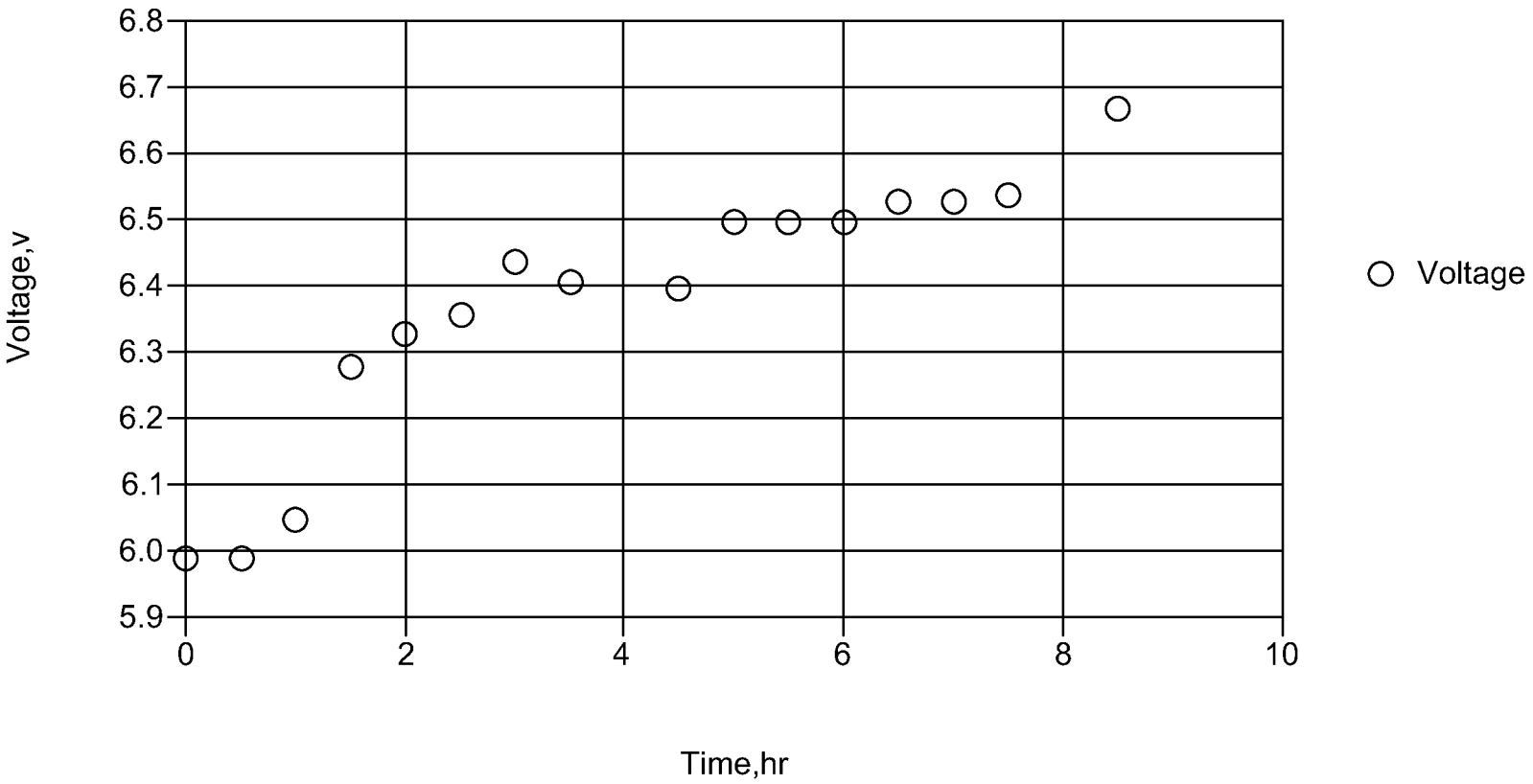
FIG. 14 shows a test data plot of battery charging time with solar panels.

Further, FIG. 10 shows an electrical schematic 190 for the charging status LED's D5 and D6 and FIG. 11 shows a test data plot using the heat sink 60 that facilitates the LED 65 being operated within its temperature limit. Continuing, FIG. 12 shows a test data plot of a steady state temperature of a LED case 65 at various forward currents without a heat sink 60, FIG. 13 shows a test data plot showing the transient temperature of the LED case 65 at various forward currents without a heat sink 60, and FIG. 14 shows a test data plot of battery 195 charging time with solar panels 70, 80.

Referring to FIG. 10, charging circuitry 190 this design has two separate sections, one to allow the U4 (LM393) to operate as a comparator when the battery 195 is being charged, while the indicator D5 turns on red when charging and green when fully charged, otherwise to eliminate the use of the comparator U4 when the circuit in not on by isolating it completely from the rest of the circuit. This technic is important because it eliminates the leakage current from the battery 195 that will save its run time. Also in FIG. 10, R21 is a limiting current from the solar panel to the charging circuitry 190, allowing the LED D5 to be on, which will activate the base of the transistor inside of the opt coupler U4.

Figure 9:
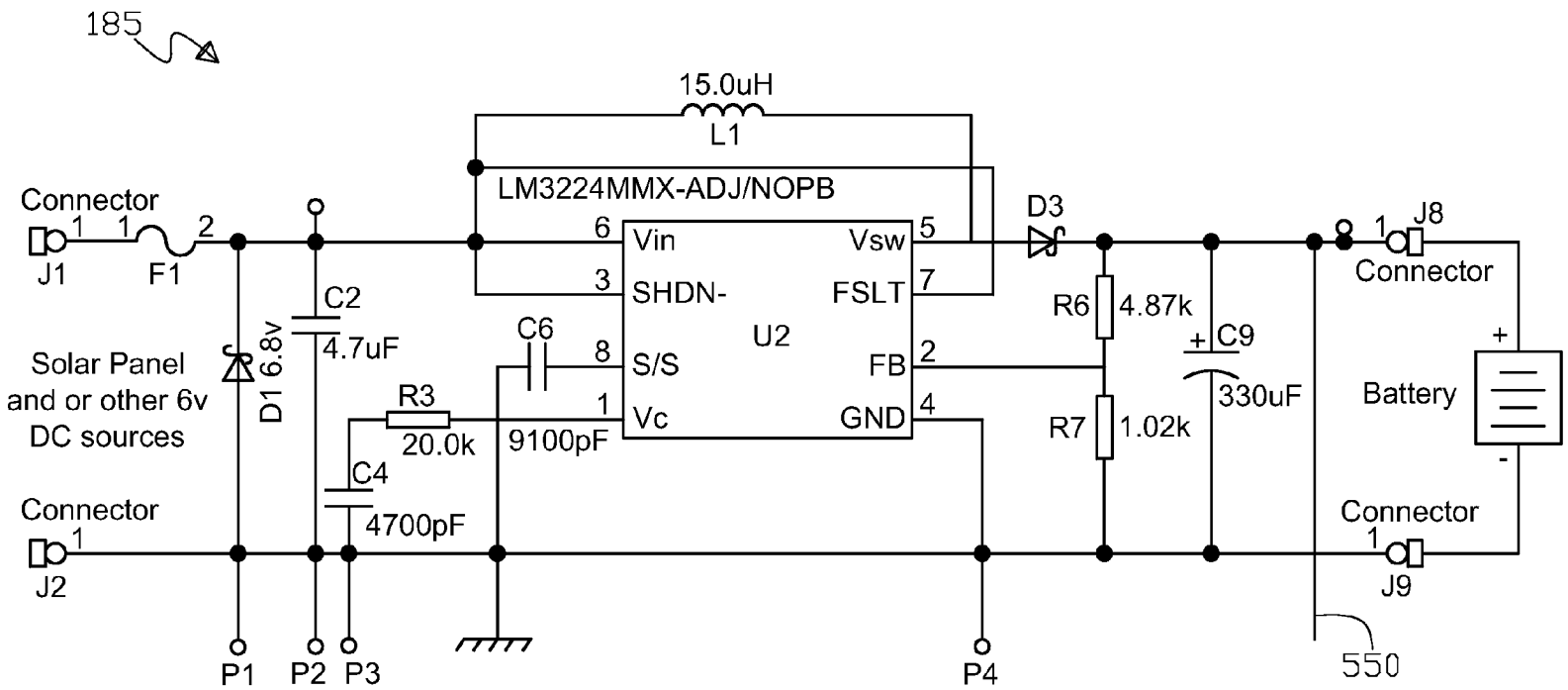
FIG. 9 shows an electrical schematic for a solar charging circuitry.

Referring to FIGS. 2, 3, and 10, two solar panels 70, 80 of 6V and 668 mA total current connected in parallel collect solar energy to be sent to a battery 195 of 6V, 4.5 AH via regulator charging circuitry 185 shown on FIG. 9.

Referring to FIG. 9, a resettle fuse, F1, at the input port from the solar panels 70, 80 wherein a positive output is used to prevent over current into the battery 195, while the Zener diode D1 is used to prevent over voltage in the charging method. Both methods are applied to protect the circuit 185 and the battery 195 from being damaged, especially if a user were to apply an overcharging situation alternative to the current solar panels 70 and 80.

Again, referring to FIG. 10, for the charging circuitry 190, the op amp comparator, U4A, connected to the solar panel 70, 80 and the battery 195 indicates the charging mechanism of the battery 195 through a comparison logic, where it compares the voltage on the solar panels 70, 80 to the divider voltage of the battery 195 to indicate that the battery 195 is charging by lighting up the LED, D5. This LED D5 remains on as long as the sun hits the solar panels 70, 80, or the AC to DC charger at connector 1 in FIG. 9 is charging the battery 195 until the voltage on the battery 195 reaches 6.5V. During this process, the divider voltage increases to 3.05V, where the LED is expected to go off. This voltage is compared to a fixed Zener diode D2 voltage of 3V with +/−1% tolerance at the positive input of the second op amp, U4B. When the divider voltage is greater than the Zener diode D2 voltage, the output of the op amp gets low, leading the second LED, D6, to turn on green, which indicates that the battery 195 is fully charged.

Referring to FIG. 9, the solar charging circuitry 185, U2 (LM3224) is a step-up PWM DC/DC converter, allowing the input operating voltage from the solar panels 70, 80 ranging from 2.7V to 7V to be regulated at a constant voltage, 7.34V, to charge the battery 195. This method delivers a constant current to the battery 195 that allows us to design around the battery manufacturer's specification to save the battery life time. According to, Texas Instruments (TI), U2 (LM3224) operates in two continuous conduction modes, following is the TI explanation about this operation.

Continuing in FIG. 9, in reference to C2, C4, R3, and C6; these input capacitors C2 and C6 are bypass capacitors allowing the U2 (LM3224) to receive a clean signal from noises coming from the input and the ground. RC network (R3 and C4) is also a filter, allowing noises to be filtered before coming into the U2 (LM3224). R6 and R7 are the feedback resistors explained in the "setting the output voltage" section below. These resistors are used to set up the output voltage. To optimize the results for better performance, we used TI simulators to generate feedback resistor values, which match our calculated value. The role of the inductor, L1, and Capacitor, C9, is explained below by TI data sheet from FIG. 8.

In referring to FIG. 8 being a simplified boost converter diagram, cycle 1 and cycle 2, for the continuous conduction mode the U2 is a current mode PEM boost regulator that steps up the input voltage to a higher output voltage. In continuous conduction mode (when the inductor current never reaches zero at steady state), the boost regulator operates in two cycles. In FIG. 8 cycle 1, the transistor is closed and the diode is reverse biased, energy is collected in the inductor and the load current is supplied by C out. The FIG. 8 cycle 2, the transistor is open and the diode is forward biased and the energy stored in the inductor is transferred to the load and output capacitor. The ratio of cycles 1 and 2 determines output voltage being approximately defined as V in divided by 1-the duty cycle of the switch multiplied by the change is the duty cycle of the switch equals one minus the duty cycle of the switch or voltage in divided by voltage out. Thus the voltage out is set by using the feedback pin and a resistor divider connected to the output as shown in the typical operating circuit. The feedback pin voltage is 1.26 volts so the ratio of the feedback resistors sets the output voltage according to the following equation; ratio feedback 1 equals ratio feedback 2 multiplied by voltage out minus 1.26 divided by 1.26 times ohms.

Nature plays a key role to reduce the efficiency of the solar panels 70, 80. These panels 70, 80 are efficient when the sun shines on them constantly, but any cloud, rain, or air particles could drastically impact the performance by reducing or fluctuating the voltage and the current output of the panels 70, 80. To solve these problems for a better functionality, U2 (LM3224) was chosen that takes account the voltage variation at the input and regulate it to the designed voltage applied to the load. For the battery 195, we have preferably used a sealed lead acid battery of 6V, 4.5 AH for our design. The choice for the battery 195 was based on the energy required by the load LED 65 to run for six hours on full brightness. Here is the power calculation for the load: P=VI. Voltage used on the load was 9V and the current pulled at full brightness for the LED 65 was 277 mA. The power calculated was: P=9 times 277=2493 mW~2.5 Watt. This is the power coming to the LED 65 load to run constant for six hours. The load refers to the LED 65.

According to the manufacturers catalog performance chart (not shown in this application) for the battery 195, the discharge rate of 0.25CA (CA=nominal capacity) at 25 degree C. on the terminal voltage of 6.5V is about 6 hours. This compares and confirms our design at the discharge rate of 0.277CA at 25 degree C.

Referring to FIG. 14, shown is the charging time versus the voltage on the battery 195. The fully discharged voltage for our design battery 195 is at 5.72V. The charge started at a voltage slightly over the fully discharged voltage. Within 6 hours of sun light on the solar panels 70, 80, a full charged voltage of 6.5V was reading on the battery 195 terminal, and time after that, a float voltage was reading on the battery 195 terminal, which is above 6.5V. The nonlinear dotted curve in FIG. 14 is due to the cloud that was in between charging times. According to this analysis, we are estimating a charging time of the light apparatus 50 with good sun light to be about 7 to 8 hours. Beyond this analysis, more data is expected to be collected to confirm the charging time.

Referring to FIG. 7, the controller circuitry 175, Vcc refers to the power supply to the control circuit from the battery 195. Capacitors C3 and C7 are bypass capacitors that clean signals from the power supply and ground before entering the chip, U3 (LM3224) and resistor 4 and capacitor 5 are connected in series to filter the signal coming from the ground to the chip, U3 (LM3224). The function of L2 and C10 matches that of the explanation of TI of L1 and C9. U3 (LM3224) is a step-up PWM DC/DC converter, allowing the input operating voltage from the battery 195 ranging from 5.72V to 6.5V to be regulated at a constant voltage of 9V output and be applied to the light source LED 65. This method delivers a constant current to the light source LED 65 that allows us to design around the LED manufacturer's specification to save the LED life time.

The problem encountered here is the heat generated by the light source LED 65 caused by the power supply to it in a closed path, which is inside of the dome 55. Hypothetically, two solutions were suggested. One is the use a poly carbonate plastic dome 55 that diffuses 95% of electrical heat, and the other one is to use a heat sink 60 with thermo compound material to eliminate air gap between the plate and the LED 65.

Below is the technical data of our experiment:

A technical report on the thermal management of the light apparatus, in this report we presented the effectiveness of our designed thermal management system. We investigated the transient and steady state temperature rise of LED 65 with and without thermal management system and calculated the heat release rate using the thermal management system.

Physical dimensions and thermal properties of heat sink 60:

Material—A16061

Heat capacity, Cp=0.91 kJ/kg ° K

Thermal conductivity, k=214 w/m ° K

Dimension=40 mm by 20 mm rectangular

A=40*20=800 $mm^2$=8*$10^{-4}$ $m^2$

Thickness, L=2 mm=2*$10^{-3}$ m

Description of Our Heat Sink 60 Manufacturing Process:

We mixed the Heat Sink compound 61 with a glue (i.e.: J-B Weld Steel and Hardener) and use this result to glue the Cree, Inc. LED 65, CXA:1034-000-000C0HC250H on an Aluminum plate with material AL6061 and dimensions described above with the Heat sink 60 section. This technique dropped the temperature of the LED 65 case from about 130 degree C. to about 50 degree C.

We also used proprietary thermal interface material (K=0.5 w/m ° K) to reduce the contact resistance between the LED 65 and heat sink 60. Using the heat sink 60 and thermal interface materials 61 the transient temperature response of the LED 65 is shown in FIG. 11. The operating temperature limit at 9 V is given by the LED 65 catalog specification (not shown in the application). Using the heat sink 60 the LED is being operated within the operating temperature limit, which is shown in FIG. 11. Therefore, the designed heat sink 60 is successful in extending the life of the LED 65. The total resistance calculated from our design also meets the requirement of the supplier of Cree XLamp CXA1304 LED 65. We also found that the thermal sink 60 releases 2.86 W heat of heat from the LED.

Referring to FIG. 6, the USB charging circuitry 170, capacitors C1 and C8, these are bypass capacitors that clean signals from the ground. U1 (LP38690-5.0/NOPB) is a low drop out linear regulator that takes in a minimum voltage of 2.7V and a maximum voltage of 10V to provide a fixed voltage by the following relationship: Vin=Vout+1 v. For our design, we are taking in 6.5V from the battery 195 and regulating it to an output voltage of 5V to charge an electronic device that take in a constant voltage of 5V for the USB port 120. For resistors R11 and R12 these are pulled up resistors for the signal and data line going through the USB 120 connector.

Referring to FIG. 5, the low input voltage comparator circuitry 165, shuts off the LED 65 when the voltage reaches the minimum voltage the LED 65 is shut off to protect the battery 195 from excessive discharge condition. U5 (LM311) series is low input current voltage comparator. It is used in our design to shut off the light LED 65 when the voltage reaches down to 5.72V. This technic allows us to save the life time of the battery 195 and prevent the end users to over discharge the battery 195. Resistor R18 is a current limiting resistor to the Zener diode D7 and resistors R16 and R17 are the divider resistors, further capacitors C15 and C16 are bypass capacitors allowing signals from the grounds to be cleaned before entering the U5 (LM311).

For the LED 65 in using Cree Relative Luminous Flux catalog graph (not shown in the application), our forward current of 277 mA corresponds to 80% Relative Luminous Flux, and the catalog flux characteristic table shows the order code for XLamp CXA1304. The one that matches our order is the CXA: 1034-000-00000HC250H. At steady-state operation of Tc=55° C., (Refer to FIG. 11 above) IF=277 mA, the relative luminous flux ratio is 80% in the chart below. A 9-V CXA1304 LED that measures 440 lm during lighting will deliver 352 lm (440 times 0.8) at steady-state operation of Tc=55° C., IF=277 mA. Therefore, our LED 65 delivers 352 lumen at full brightness. Table Reference: CREE product family data sheet, 20130621CLDDS73CXA1304Rev0.pdf.

Broadly in referring to FIGS. 1 to 10, the light apparatus 50 that is portable and self-sustaining includes the solar panel 70, 80 for converting varying light 51 into a varying solar electrical energy, further included in the light apparatus 50 is the storage structure 195 capable of receiving electrical energy having a controlled current and voltage, storing electrical energy, and discharging electrical energy having fluctuating current and voltage, with the storage structure having a plurality of receiving, storing, and discharging electrical energy cycles. Also included in the light apparatus 50 is the structure that emits light 65 via a consumption a stored electrical energy at a constant current and voltage and control circuitry 175, 185 that is in electrical communication with the solar panel 70, 80, the storage structure 195, and the structure that emits light 65.

Wherein the control circuitry 175, 185, as best shown in FIGS. 7 and 9, has a first mode that is operable to receive the varying solar panel 70, 80 electrical energy and output a constant current and voltage electrical energy to the storage structure 195 to maximize the storage structure 195 plurality of electrical energy cycles possible. The control circuitry 175, 185 also has a second mode that is operable to receive the storage structure 195 discharging electrical energy having fluctuating current and voltage and output a constant current and voltage to the structure that emits light 65 for a consistent light brightness and maximum light emitting structure life.

Optionally, for the light apparatus 50, it can further comprise the heat sink 60 that has a planar shape with a pair of parallel planar surfaces, see in particular FIG. 3, wherein the heat sink has a thermo compound 61 disposed as between the structure that emits light 65 and one of the planar surfaces to facilitate direct heat transfer conduction and minimize a differential temperature from the structure that emits light 65 and the planar surface. Wherein operationally, the heat sink 60 reduces an operating temperature of the structure that emits light 65 to extend the operating life of the structure that emits light 65.

Further, on the heat sink 60 its planar surfaces have an area 62 of at least nine (9) times of an area for a largest single surface area 66 of the structure that emits light 65, being determined from test data to be an adequate heat transfer area 62 for the heat sink 60 to keep the structure that emits light 65 at an acceptable temperature.

Additionally, as an option on the light apparatus 50 it can further comprise auxiliary circuitry 170, see FIG. 6, that is in electrical communication with the storage structure 195, the auxiliary circuitry 170 is to electrically power a Universal Serial Bus (USB) port 120 from the storage structure 195, wherein the auxiliary circuitry 170 has an operating mode to receive the storage structure 195 discharging electrical energy having fluctuating current and voltage and output a constant current and voltage to the Universal Serial Bus (USB) port 120 to electrically power an auxiliary device 160.

Further, on the light apparatus 50, it can further comprise storage structure protection circuitry 165, see FIG. 5, that is in electrical communication with the storage structure 195 and the structure that emits light 65, the storage structure protection circuitry 165 has an operating mode to deactivate the structure that emits light 65 when an output voltage of the storage structure 195 equals a specified level that is operational to prevent over discharge of the storage structure 195 that would reduce the plurality of receiving, storing, and discharging electrical energy cycles.

Alternatively, for the light apparatus 50 that is portable and self-sustaining can also include the first solar panel 70 for converting varying light into a varying solar electrical energy, with the first solar panel 70 having the first periphery 71, with the first solar panel housing 75 disposed about the first solar panel 70 first periphery 71, as best shown in FIGS. 2 and 3. Further included in the light apparatus 50 is the second solar panel 80 for converting varying light into a varying solar electrical energy, with the second solar panel 80 having a second periphery 81, wherein the second solar panel housing 85 is disposed about the second solar panel 80 second periphery 81.

Also included for the light apparatus 50, as best shown in FIGS. 1 to 3, is the pivotal hinge 90 disposed between a portion of the first solar panel 70 housing 75 and a portion of the second solar panel 80 housing 85, wherein the pivotal hinge 90 is operational to fold the first 70 and second 80 solar panels inward to be adjacent toward one another in a clam shell type arrangement in a closed state 95 to minimize the light apparatus 50 size, see FIG. 1. In addition, the pivotal hinge 90 is operational to unfold the first 70 and second 80 solar panels outward away from one another to form a first plane 101 as between the first 70 and second 80 solar panels in an open state 100, wherein the first 70 and second 80 solar panels receive the varying light 51 in the open state 100 only, see in particular FIG. 2.

Further in the light apparatus 50, the storage structure 195 capable of receiving electrical energy having a controlled current and voltage, storing electrical energy, and discharging electrical energy having fluctuating current and voltage, the storage structure 195 having a plurality of receiving, storing, and discharging electrical energy cycles, see FIG. 9. Also, included in the light apparatus 50, is the structure that emits light 65 via a consumption a stored electrical energy at a constant current and voltage and control circuitry 175, 185, see FIGS. 7 and 9, that is in electrical communication with the first 70 and second 80 solar panels, the storage structure 195, and the structure that emits light 65. Wherein, the control circuitry 175, 185 has a first mode that is operable to receive the varying solar electrical energy and output a constant current and voltage electrical energy to the storage structure 195 to maximize the storage structure 195 plurality of electrical energy cycles. The control circuitry 174, 185 has a second mode that is operable to receive the storage structure 195 discharging electrical energy having fluctuating current and voltage and output a constant current and voltage to the structure that emits light 65 for a consistent light brightness and maximum light emitting structure 65 life.

Optionally, on the light apparatus 50, it can further comprise the base 110 and the surrounding sidewall 105 extending from the base 110, with the surrounding sidewall 105 terminating in the sidewall margin 106, see in particular FIGS. 1 to 3. Wherein the base 110 and the surrounding sidewall 105 define the first interior 107, wherein the first interior 107 forms a housing 111 that the storage structure 195 and the control circuitry 175, 185 are disposed within, see in particular FIG. 3.

In addition, for the light apparatus 50, a portion of the second solar panel 80 housing 85 is affixed 86 to the sidewall 105 margin 106 opposite of the second solar panel 80 and wherein the first solar panel 70 housing 75 is affixed 76 to the structure that emits light 65 opposite of the first solar panel 70, see FIGS. 1 to 3. Further, for the light apparatus 50, the first plane 101 can form an acute angle 102 with the base 110 when the first 70 and second 80 solar panels are in the open state 100 via the first 75 and second 85 solar panel housings structurally positioning the first 70 and second 80 solar panels at the acute angle 102 to operationally increase an intensity of the varying light 51 by orienting the first plane 101 to be more perpendicularly positioned 103 to the varying light 51, see FIG. 2.

CONCLUSION

Accordingly, the present invention of the light apparatus has been described with some degree of particularity directed to the embodiments of the present invention. It should be appreciated, though; that the present invention is defined by the following claims construed in light of the prior art so modifications or changes may be made to the exemplary embodiments of the present invention without departing from the inventive concepts contained therein.

The invention claimed is:

1. A light apparatus that is portable and self-sustaining, said light apparatus comprising:

(a) a first solar panel for converting varying light into a varying solar electrical energy, said first solar panel having a first periphery;

(b) a first solar panel housing disposed about said first solar panel first periphery;

(c) a second solar panel for converting varying light into a varying solar electrical energy, said second solar panel having a second periphery;

(d) a second solar panel housing disposed about said second solar panel second periphery;

(e) a pivotal hinge disposed between a portion of said first solar panel housing and a portion of said second solar panel housing, wherein said pivotal hinge is operational to fold said first and second solar panels inward to be adjacent toward one another in a clam shell type arrangement in a closed state to minimize said light apparatus size and said pivotal hinge is operational to unfold said first and second solar panels outward away from one another to form a first plane as between said first and second solar panels in an open state, wherein said first and second solar panels receive the varying light in said open state only;

(f) a storage structure capable of receiving electrical energy having a controlled current and voltage, storing electrical energy, and discharging electrical energy having fluctuating current and voltage, said storage structure having a plurality of receiving, storing, and discharging electrical energy cycles;

(g) a structure that emits light via a consumption a stored electrical energy at a constant current and voltage; and (h) control circuitry that is in electrical communication with said first and second solar panels, said storage structure, and said structure that emits light, wherein said control circuitry has a first mode that is operable to receive said varying solar electrical energy and output a constant current and voltage electrical energy to said storage structure to maximize said storage structure plurality of said electrical energy cycles, said control circuitry has a second mode that is operable to receive said storage structure discharging electrical energy having fluctuating current and voltage and output a constant current and voltage to said structure that emits light for a consistent light brightness and maximum light emitting structure life.

2. A light apparatus according to claim 1 further comprising a base and a surrounding sidewall extending from said base, said surrounding sidewall terminating in a sidewall margin, wherein said base and said surrounding sidewall define a first interior, wherein said first interior forms a housing that said storage structure and said control circuitry are disposed within.

3. A light apparatus according to claim 2 wherein a portion of said second solar panel housing is affixed to said sidewall margin opposite of said second solar panel and wherein said first solar panel housing is affixed to said structure that emits light opposite of said first solar panel.

4. A light apparatus according to claim 3 wherein said first plane forms an acute angle with said base when said first and second solar panels are in said open state via said first and second solar panel housings structurally positioning said first and second solar panels at said acute angle to operationally increase an intensity of the varying light by orienting said first plane to be more perpendicularly positioned to the varying light.

5. A light apparatus according to claim 4 further comprising a heat sink that has a planar shape with a pair of parallel planar surfaces, wherein said heat sink has a thermo compound disposed as between said structure that emits light and one of said planar surfaces to facilitate direct heat transfer conduction and minimize a differential temperature from said structure that emits light and said planar surface, wherein operationally said heat sink reduces an operating temperature of said structure that emits light to extend the operating life of said structure that emits light.

6. A light apparatus according to claim 5 wherein each of said heat sink planar surfaces has an area of at least nine (9) times of an area for a largest single surface area of said structure that emits light.

7. A light apparatus according to claim 6 further comprising auxiliary circuitry that is disposed within said first interior, said auxiliary circuitry is in electrical communication with said storage structure, said auxiliary circuitry is to electrically power a Universal Serial Bus (USB) port from said storage structure, wherein said Universal Serial Bus (USB) port is disposed therethrough said surrounding sidewall, wherein said auxiliary circuitry has an operating mode to receive said storage structure discharging electrical energy having fluctuating current and voltage and output a constant current and voltage to said Universal Serial Bus (USB) port to electrically power an auxiliary device.

8. A light apparatus according to claim 6 further comprising storage structure protection circuitry that is disposed within said first interior, said storage structure protection circuitry is in electrical communication with said storage structure and said structure that emits light, said storage structure protection circuitry has an operating mode to deactivate said structure that emits light when an output voltage of said storage structure equals a specified level that is operational to prevent over discharge of said storage structure that would reduce said plurality of receiving, storing, and discharging electrical energy cycles.

* * * * *